United States Patent [19]

Inoue et al.

[11] 4,415,256

[45] Nov. 15, 1983

[54] APPARATUS FOR TRANSFERRING IMAGES

[75] Inventors: Takahiro Inoue; Yusaku Takada, both of Yokohama; Takao Aoki, Abiko, all of Japan

[73] Assignee: Canon Kabushiki Kaisha, Tokyo, Japan

[21] Appl. No.: 381,468

[22] Filed: May 24, 1982

[30] Foreign Application Priority Data

Jun. 1, 1981 [JP] Japan ..... 56-84198

[51] Int. Cl.[3] ..... G03G 15/00

[52] U.S. Cl. ..... 355/3 TR; 355/3 R

[58] Field of Search ..... 355/3 TR, 3 R, 4, 77; 430/126

[56] References Cited

U.S. PATENT DOCUMENTS 3,879,121 4/1975 Simpson ..... 355/3 TR 4,223,993 9/1980 Tsuda et al. ..... 355/3 TR

*Primary Examiner*—R. L. Moses

*Attorney, Agent, or Firm*—Fitzpatrick, Cella, Harper & Scinto

[57] ABSTRACT

An apparatus for transferring a developed image on an image bearing member includes a transfer corona discharger disposed in opposition to the transfer position of the image bearing member, transfer material bearing member having a dielectric transfer material bearing surface and disposed to move the transfer material passing through the area between the image bearing member and the transfer corona discharger, and transfer material attraction charge applying device disposed on the downstream of the transfer position and in the space between the surface of the image bearing member and the transfer material bearing surface of the transfer material bearing member.

16 Claims, 10 Drawing Figures

APPARATUS FOR TRANSFERRING IMAGES

BACKGROUND OF THE INVENTION

1. Field of the Invention

The present invention relates to apparatus for transferring images. More particularly, the present invention relates to apparatus for carrying out multitransfer of images onto a transfer material supported on circulating transfer material bearing means.

2. Description of the Prior Art

A multitransfer apparatus is known in the art and used, for example, in a multicolor copying machine. In the known multicolor copying machine, images in different colors are sequentially formed on an image bearing member such as a photosensitive drum. The individual color images are then transferred onto a transfer material from the image bearing member by multiple transferring. In transferring, the transfer material is supported on transfer material bearing means having a dielectric surface in the form of sheet or mesh. Under the action of corona discharge, each of the color images is transferred onto the transfer material supported by said bearing means. After transferring, the transfer material is separated from the photosensitive drum and said transfer material bearing means carries the separated transfer material on its surface. At this step of separation, it is desirable that the transfer material subjected to the action of transfer corona be separated from the drum surface while keeping the transfer material in close contact with the surface of transfer material bearing means. However, in practice, the transfer material cannot completely be separated from the photosensitive drum at once after passing over the transfer position at which said transfer material bearing means and the photosensitive drum come into contact with each other for transferring. Even after the transfer material has already passed over the transfer position, the transfer material continues to be in close contact with the photosensitive drum some distance. Therefore, the transfer material gets in contact with said transfer material bearing means only when the transfer material has moved some distance together with the photosensitive drum after transferring. Even if the transfer material is separated from the photosensitive drum at once after transferring, the transfer material does not come into close contact with the surface of transfer material bearing means but moves floating in the space between the photosensitive drum and said transfer material bearing means. The transfer material gets in contact with the surface of said bearing means only when it has moved floating some distance after transferring. In either case, after transferring, the transfer material moves some distance in the state of floating in the air above the surface of said transfer material bearing means. In the known apparatus, therefore, some problems have been caused by such floating movement of the transfer material after transferring.

Firstly, the separation position at which the transfer material is separated from the surface of the photosensitive drum is not constant but variable which gives an adverse effect on the transferred image on the transfer material. Since the floating transfer material moves in unstable manner, some distortion is produced in the transferred images on the transfer material by offset etc. Such distorted images have difficulty in copy making in particular when it is desired to obtain images of high resolution.

Secondly, the floating movement of the transfer material leads to the problem of out-of-registration in multicolor image. When the transfer material is out of the surface of transfer material bearing means, the distance moved by the transfer material becomes longer than the normal passage along the surface of said transfer material bearing means. In case of the multi-transfer, the floating movement of transfer material is at the greatest degree for the first color. From the second color on, the degree of floating is reduced or there occurs no floating of the transfer material. Therefore, the first color image and other color images from the second color on transferred on the transfer material are not in registration but out of registration in color. Such error in registration will result in degraded reproduction of multicolor image.

Lastly, the floating movement of the transfer material constitutes the main cause for wrong conveyance of transfer material.

The mechanism of the above floating phenomenon of the transfer material has not been made fully clear yet. But, it may be said that the floating phenomenon occurs when the electrostatic attraction force of the transfer material bearing member acting on the transfer material is overcome by the attraction force of the photosensitive drum acting on the same transfer material. Also, it is believed that the floating phenomenon is partly attributable to the stiffness of the transfer material itself and to the curvature of the surface of said transfer material bearing means. The present invention is based on this understanding of the floating phenomenon.

SUMMARY OF THE INVENTION

Accordingly, it is an object of the invention to provide a novel and superior transfer apparatus.

It is another object of the invention to provide such transfer apparatus which enables to carry out multitransfer of multicolor images without any problem of out-of-registration in color.

To attain the above objects according to the invention, there is provided a transfer apparatus for transferring developed images from an image bearing member onto a transfer material on transfer material bearing means, said transfer apparatus being characterized in that said apparatus includes transfer corona discharging means disposed opposed to the transfer position of said image bearing member, transfer material bearing means provided with a dielectric transfer material bearing surface and disposed to move the transfer material passing through between said image bearing member and said transfer corona discharging means, and transfer material attraction charge applying means disposed between said image bearing member and said bearing surface of transfer material bearing means on the downstream side of the transfer position.

Other and further objects, features and advantages of the invention will appear more fully from the following description of preferred embodiments with reference to the accompanying drawings.

DESCRIPTION OF PREFERRED EMBODIMENTS

Hereinafter the present invention will be described in detail with reference some embodiments thereof in which the transfer apparatus of the invention is applied to a copying machine having a photosensitive drum as the image bearing member. As circulating transfer material bearing means there is used a transfer drum for supporting thereon a transfer material. For multi-transfer the developed images on the photosensitive drum are transferred onto the transfer material supported on the transfer drum.

Figure 1:
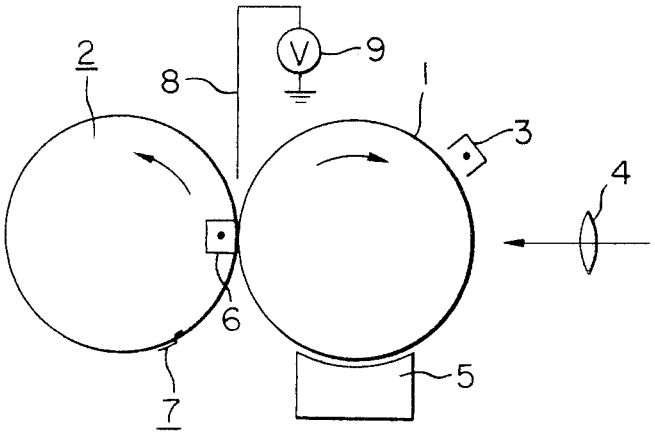
FIG. 1 is a schematic view of a transfer apparatus showing an embodiment of the invention.

Referring first to FIG. 1, the photosensitive drum is designated by 1 and the transfer drum by 2. 3 is a charger, 4 is an image exposure optical system, 5 is a developing device and 6 is a transfer corona discharger disposed opposed to the photosensitive drum 1. 7 is a gripper comprising a plural number of gripping elements $7_1$ to $7_3$ (FIG. 2) arranged at suitable intervals for gripping the leading end of a transfer material. Designated by 8 is a needle-shaped electroconductive member serving as transfer material attraction charge applying means (which is referred to hereinafter as needle electrode). 9 is a bias voltage source.

Figure 2:
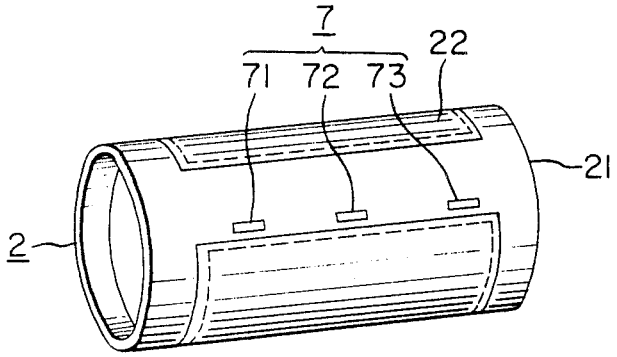
FIG. 2 is a perspective view of the transfer drum shown in FIG. 1.

The photosensitive drum 1 is composed of an electroconductive cylinder covered with a layer of photoconductive material such as Se, CdS or ZnO. As shown in FIG. 2, the transfer drum 2 is composed of a cylinder 21 having a cutout central portion and a sheet or porous mesh of dielectric material 22 covering the cutout portion of the cylinder. Examples of the dielectric material 22 are polyester, nylon and polypropylene. To sequentially form images in different colors on the photosensitive drum and transfer them on the transfer material in the fashion of multi-transfer there may be provided a plural number of developing devices 5 for different colors.

Figure 3:
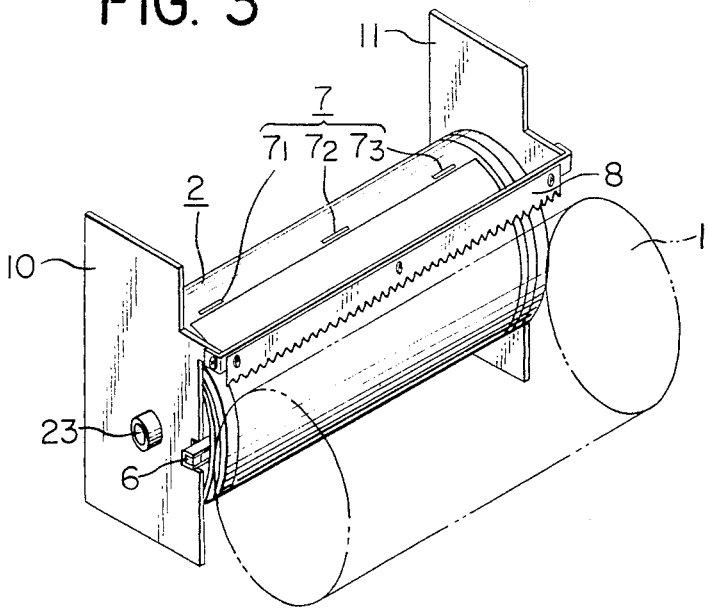
FIG. 3 is a perspective view of a part of the transfer apparatus shown in FIG. 1.

FIG. 3 is a detailed perspective view of the transfer apparatus part of the copying machine shown in FIG. 1. In FIGS. 3, 10 and 11 are a pair of side plates for rotatably supporting the shaft 23 of the transfer drum 2.

In the above shown copying machine, the surface of the photosensitive drum 1 is charged by the charger 3 and then exposed to the light image of an original through the optical system 4 to form an electrostatic latent image on the drum surface. The electrostatic latent image is developed into a toner image by the developing device 5. The transfer drum 2 having dielectric surface 22 bears a transfer material whose leading end is held by the gripper 7. The transfer material may be a paper sheet or a transparent film (OHP). The transfer material is moved between the photosensitive drum 1 and the transfer corona discharger 6 while winding the transfer material round the surface of the transfer drum 2. At the time, the toner image formed on the photosensitive drum 1 is transferred onto the transfer material under the action of the transfer corona discharger 6. The transfer drum 2 carries the transfer material on its surface under an electrostatic attraction force acting on the transfer material. After separating the transfer material from the surface of the photosensitive drum 1, the electrostatic attraction force is increased up by the needle electrode 8 biased by the bias voltage source 9. Under the increasing electrostatic attraction force, the drum 2 bears the transfer material on it and carries it further with the rotation of the drum. The needle electrode 8 serves to prevent the floating phenomenon of the transfer material previously described. Thereby, rising of the transfer material toward the photosensitive drum 1 from the transfer drum 2 is minimized so as to essentially eliminate the adverse effect of floating on the quality of transferred image.

After a further movement of the transfer material with the transfer drum from the transfer position, the transfer material is separated from the transfer drum 2 and then discharged from the machine. If necessary, the transfer material is further rotated with the rotation of the transfer drum for the next transfer of a multi-transfer operation.

Figure 4:
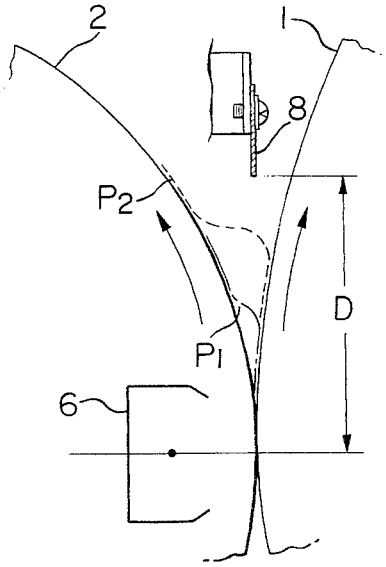
FIG. 4 is a schematic view to illustrate the manner of floating of the transfer material and the location of transfer material attraction charge applying means.

FIG. 4 shows the positional relation between the transfer position of the transfer apparatus and the location of transfer material attraction charge applying means.

In FIG. 4, D is the distance from the transfer position to the tip end of said charge applying means. $P_1$ illustrates the state of rising of the transfer material from the surface of the transfer drum 2 when said transfer material attraction charge applying means is operated. $P_2$ illustrates the rising state when said charge applying means is not used. As previously noted, when the degree of the floating of the transfer material is great, there is caused by it the problem of out-of-registration in color in a multi-transfer. It there is produced such out-of-registration, for example, in the order of 0.3 mm, then the image quality will be degraded to the extent that it is no longer acceptable as a faithful reproduction of a multi-color image.

To demonstrate the effect of this embodiment, we conducted an experiment using a transfer drum of 180 mm in diameter on which a polyester screen (70 mesh; 300$\mu$ thick) is applied as the transfer material bearing surface. The photosensitive drum was 360 mm in diameter. When the distance D from the transfer position to the tip end of said transfer material attraction charge applying means was set to a value smaller than 80 mm, there was obtained a substantial effect to prevent the above floating of the transfer material. It was found that the distance D suitable for eliminating the above-mentioned problem of out-of-registration in color is smaller than 60 mm.

Figure 5A:
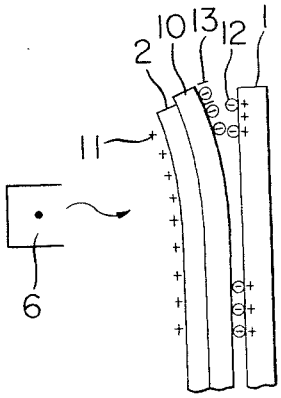
FIG. 5A is a schematic view to illustrate the distribution of charge at the separation of transfer material.
Figure 5B:
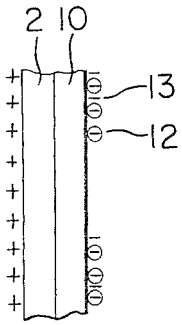
FIG. 5B is a schematic view to illustrate the distribution of charge after separating the transfer material without application of charge by said transfer material attraction charge applying means.
Figure 5C:
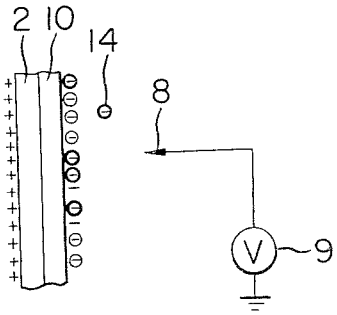
FIG. 5C is a view similar to FIG. 5B showing the distribution of charge obtained when said transfer material attraction charge applying means was operated.

FIG. 5A illustrates the distribution of charges at the time of the transfer material being separated from the photosensitive drum 1 after transferring the toner image onto the transfer material. FIG. 5B shows the charge distribution as obtained when said transfer material attraction charge applying means is operated and FIG. 5C shows the charge distribution as obtained when said charge applying means is not operated.

In FIG. 5, the transfer material is designated by 10. 11 is charge applied by the transfer corona discharger 6. 12 is toner, 13 is charge resulting from aerial discharge and 14 is charge given by discharge from said transfer material attraction charge applying means (needle-electrode).

In FIG. 5A, toner particles 12 are adhered on the photosensitive drum 1 in the pattern corresponding to the latent image charges (which are assumed to be positive charges for the purpose of explanation) on the drum 1. The transfer material 10 on the transfer drum 2 comes into contact with the surface of the photosensitive drum 1 and transfer charges are applied to the transfer drum 2 by the transfer corona discharger 6. Transferring by corona has the advantage that there is no problem of poor transfer of character part at its center portion as usually observed in transferring by roller. By charging from the corona discharger 6, the transfer material bearing member 2 has positive charges 11 on the backside surface thereof. When the transfer material 10 and the transfer material bearing member 2 move separating from the photosensitive drum 1, the toner 12 on the photosensitive drum and the charge 13 resulting from the aerial discharge at the separation adhere to the surface of the transfer material 10 under the action of the positive transfer charge 11. In the case shown in FIG. 5B wherein said transfer material attraction charge applying means is not operated, the total charge density of the toner 12 and the charge 13 on the transfer material 10 is lower than that of the transfer charge 11 given by the transfer corona discharger 6.

However, according to the invention, there is provided transfer material attraction charge applying means (needle electrode) 8 at a position immediately after the separation position of the transfer material from the photosensitive drum 1. The needle electrode 8 serves to increase the electrostatic attraction force acting on the transfer material carried by the transfer drum 2 after transferring as shown in FIG. 5C. The needle electrode 8 also has an effect to shift the separation position toward the transfer position. Consequently, rising of the transfer material from the surface of the transfer drum after transferring (floating phenomenon) is minimized or completely prevented.

In the above transfer apparatus, the electrostatic attraction force between the transfer material 10 and the transfer material bearing member 2 is produced by the positive and negative charges which attract each other. Therefore, it is possible to increase up the electrostatic attraction force by applying additional negative charge on the surface of the transfer material. Under the effect of positive charge 11, the surface potential on the transfer material becomes very high. For example, it reaches the level of 3000 V or more. Such a high potential cannot be attained by the transfer material alone. Since the transfer material bearing member is a dielectric material, the transfer material can reach such high surface potential. This high potential (and charges) remains undecayed for a relatively long time. Therefore, the transfer material is kept in the state electrostatically attracted by the transfer material bearing member.

When the needle electrode 8 is operated immediately after the separation of the transfer material 10 from the photosensitive drum 1, there occurs discharge from the needle electrode because of the high surface potential over 3000 V on the transfer material. As a result, negative charge 14 adheres to the surface of the transfer material. The needle electrode 8 may be grounded. However, more effective control of the attraction force can be attained by connecting the needle electrode to a bias voltage source 9. In this manner, the electrostatic attraction force is increased up by the negative charge 14 additionally applied by the needle electrode.

If the density of positive charge on the backside of the transfer material bearing member 2 becomes equal to the density of negative charge on the surface of the transfer material, then it is no longer possible to effect multi-transfer. However, since the discharge of the needle electrode 8 cannot add the negative charge so much, there is no afraid of such case. To obtain a better effect, the needle electrode 8 should be located as close as possible to the separation position of the transfer material from the photosensitive drum. The reason for this is that the force intending to move the transfer material away from the transfer material bearing member is mainly the electrostatic force of the photosensitive drum. The needle electrode is so located as to counteract the electrostatic force of the photosensitive drum.

Figure 6A:
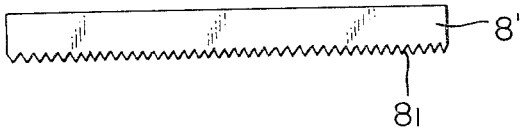
FIGS. 6A, 6B and 6C show various forms of transfer material attraction charge applying means.
Figure 6B:
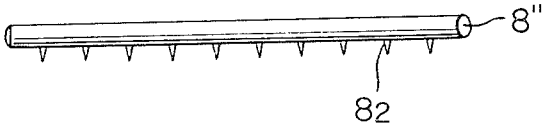
Figure 6C:
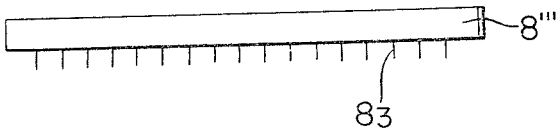

For transfer material attraction charge applying means there may be used various forms as shown in FIGS. 6A, 6B and 6C.

In the embodiment shown in FIG. 6A, said charge applying means is formed of a metal plate 0.1 to 0.5 mm thick having a series of saw tooth $8_1$ formed along one edge of the metal plate 8'. In the second embodiment shown in FIG. 6B, said attraction charge applying means is formed of a rod of electroconductive material 8'' and a number of needles $8_2$ fixed to the rod. The embodiment of attraction charge applying means shown in FIG. 6C comprises a base member 8''' and a number of bundles of carbon fibers or thin stainless steel wires $8_3$ fixed to the base member. Also, simple wire and the like may be used as attraction charge applying means provided that uniform discharge can be applied from the tip end of it.

As readily understood from the foregoing, the present invention enables to carry out good transfer of images without any out-of-registration in color. According to the embodiment described in the above, transfer material bearing means has a surface of dielectric material. A transfer material is carried by said bearing member while the transfer material being electrostatically attracted onto the surface of said bearing means. A corona charger performs the function of electrostatic attraction and also the function of transfer. Immediately after the transfer material is separated from the photosensitive drum, additional charge is applied to the transfer material by transfer material attraction charge applying means such as a needle-shaped electroconductive member to attain the purpose of good transfer of images.

While the invention has been particularly shown and described with reference to preferred embodiments thereof, it is to be understood that the invention is not limited thereto but may be otherwise variously embodied within the scope of the following claims.

What we claim is:

1. Apparatus for transferring a developed image on an image bearing member onto a transfer material supported on transfer material bearing means, said transfer apparatus being characterized by the provision of transfer corona discharge means disposed opposed to the transfer position of the image bearing member; transfer material bearing means having a dielectric transfer material bearing surface and disposed to move the transfer material passing between said image bearing member and said transfer corona discharge means; and transfer material attraction charge applying means disposed on the downstream side of said transfer position and in the space between the surface of said image bearing member and the transfer material bearing surface of said transfer material bearing means.

2. A transfer apparatus as set forth in claim 1, which is characterized in that said transfer material bearing means is a drum having an opening covered with a dielectric sheet.

3. A transfer apparatus as set forth in claim 1, which is characterized in that said transfer material bearing means is a drum having an opening covered with a dielectric screen.

4. A transfer apparatus as set forth in claim 2 or 3, is characterized in that said transfer material bearing means is provided with a gripper for holding the leading end of the transfer material.

5. A transfer apparatus as set forth in claim 1, which is characterized in that said transfer material attraction charge applying means comprises a needle electrode.

6. A transfer apparatus as set forth in claim 1, which is characterized in that said transfer material attraction charge applying means comprises a saw tooth electrode.

7. A transfer apparatus as set forth in claim 1, which is characterized in that said transfer material attraction charge applying means comprises a thin wire electrode.

8. A transfer apparatus as set forth in claim 1, which is characterized in that the discharge electrode of said transfer material attraction charge applying means is directed to the transfer position.

9. Apparatus for transferring a developed image formed on an endless moving image bearing member onto a transfer material supported on transfer material bearing member, said transfer apparatus being characterized by:

transfer corona discharge means disposed opposed to the transfer position of said image bearing member;

transfer material bearing means having a dielectric transfer material bearing surface and disposed for cyclically moving the transfer material passing through between said image bearing member and transfer corona discharge means; and transfer material attraction charge applying means disposed on the downstream side of the transfer position and in the space between the surface of said image bearing member and the image bearing surface of said transfer material bearing means.

10. A transfer apparatus as set forth in claim 9, which is characterized in that said transfer material bearing means is a drum having an opening covered with a dielectric sheet.

11. A transfer apparatus as set forth in claim 9, which is characterized in that said transfer material bearing means is a drum having an opening covered with a dielectric screen.

12. A transfer apparatus as set forth in claim 10 or 11, which is characterized in that said transfer material bearing means is provided with a gripper for holding the leading end of the transfer material.

13. A transfer apparatus as set forth in claim 9, which is characterized in that said transfer material attraction charge applying means comprises a needle electrode.

14. A transfer apparatus as set forth in claim 9, which is characterized in that said transfer material attraction charge applying means comprises a saw tooth electrode.

15. A transfer apparatus as set forth in claim 9, which is characterized in that said transfer material attraction charge applying means comprises a thin wire electrode.

16. A transfer apparatus as set forth in claim 9, which is characterized in that the discharge electrode of said transfer material attraction charge applying means is directed to the transfer position.

* * * * *

UNITED STATES PATENT AND TRADEMARK OFFICE

CERTIFICATE OF CORRECTION

PATENT NO. : 4,415,256

DATED : November 15, 1983

INVENTOR(S) : TAKAHIRO INOUE, ET AL.

It is certified that error appears in the above-identified patent and that said Letters Patent is hereby corrected as shown below:

Column 1, line 35, "at once" should read --immediately--;
line 41, insert --for-- between "drum" and --some--;
line 42, "gets" should read --comes--;
line 46, "at once" should read --immediately--;
line 51, "gets" should read --comes--;
line 67, insert a --,-- after "offset".

Column 2, line 9, "case" should read --cases--; delete "the" (first occurrence);
line 20, change "wrong" to --incorrect--;
line 39, delete "to carry out";
line 49, change "opposed" to --in opposition--;
line 53, delete "through".

Column 3, line 21, insert --to-- after "reference";
line 34, "opposed" should read --in opposition--;
line 57, "Figs." should read --Fig.--.

Column 4, line 4, before "time" insert --same--;
line 62, delete "of"; change "being" to --is--.

Column 5, line 49, delete "up";
line 66, insert --of-- before "over".

UNITED STATES PATENT AND TRADEMARK OFFICE

CERTIFICATE OF CORRECTION

PATENT NO. : 4,415,256 Page 2 of 2

DATED : November 15, 1983

INVENTOR(S) : TAKAHIRO INOUE, ET AL.

It is certified that error appears in the above-identified patent and that said Letters Patent is hereby corrected as shown below:

Column 6, line 4, delete "up";
line 11, change "the" to --much--; delete "so";
line 12, delete "much"; "afraid" should read --fear--;
line 26, "tooth" should read --teeth--;
line 39, delete "to carry out";
line 44, change "being" to --is--;
line 64, Claim 1, "opposed" should read --in opposition--.

Column 7, line 15, Claim 4, insert --which-- before "is".

Column 8, line 1, Claim 9, "opposed" should read --in opposition--;
line 6, delete "through".

Signed and Sealed this

*Twenty-sixth* Day of *June 1984*

[SEAL]

*Attest:*

GERALD J. MOSSINGHOFF

*Attesting Officer*

*Commissioner of Patents and Trademarks*